US007259755B1

(12) United States Patent
Ahn

(10) Patent No.: US 7,259,755 B1
(45) Date of Patent: Aug. 21, 2007

(54) METHOD AND APPARATUS FOR DRIVING LIQUID CRYSTAL DISPLAY PANEL IN INVERSION

(75) Inventor: Seung Kuk Ahn, Kumi-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 881 days.

(21) Appl. No.: 09/654,943

(22) Filed: Sep. 1, 2000

(30) Foreign Application Priority Data

Sep. 4, 1999 (KR) ..... 1999-37587

(51) Int. Cl.
*G09G 3/36* (2006.01)

(52) U.S. Cl. ..... 345/204; 345/87; 345/95; 345/210; 348/800

(58) Field of Classification Search ..... 345/87, 345/95, 96, 204, 205, 209, 210; 348/790, 348/793, 800
See application file for complete search history.

(56) References Cited

U.S. PATENT DOCUMENTS 5,488,388 A * 1/1996 Taniguchi et al. ..... 345/97
5,739,804 A * 4/1998 Okumura et al. ..... 345/99
5,847,687 A * 12/1998 Hirakata et al. ..... 345/96
5,945,972 A * 8/1999 Okumura et al. ..... 345/98
6,097,352 A * 8/2000 Zavracky et al. ..... 345/7
6,271,816 B1 * 8/2001 Jeong et al. ..... 345/87
6,327,008 B1 * 12/2001 Fujiyoshi ..... 349/106
6,335,719 B1 * 1/2002 An et al. ..... 345/98
6,342,876 B1 * 1/2002 Kim ..... 345/87
6,400,350 B1 * 6/2002 Nishimura et al. ..... 345/96
6,496,172 B1 * 12/2002 Hirakata ..... 345/96
6,559,822 B2 * 5/2003 Okuzono ..... 345/96
6,628,274 B1 * 9/2003 Morita ..... 345/209

FOREIGN PATENT DOCUMENTS

KR 2002-07618 2/2000

OTHER PUBLICATIONS

Office Action issue by Korean Patent Office on Mar. 13, 2006.

* cited by examiner

*Primary Examiner*—Bipin Shalwala
*Assistant Examiner*—Vincent E. Kovalick
(74) *Attorney, Agent, or Firm*—McKenna Long & Aldridge LLP

(57) ABSTRACT

A method and apparatus for driving a liquid crystal panel in a line-inversion system is disclosed. In the method, at least one pixel block each of which includes at least two data lines within the liquid crystal panel is set. The adjacent pixels in a gate line direction within the pixel block respond to data signals having the same polarity. The pixels within the other pixel areas except for the pixel block respond to data signals having a polarity contrary to the adjacent pixels at the left and right sides thereof. Accordingly, a current amount charged in the adjacent pixels having a large brightness difference is supplied always equally, so that the brightness difference between the adjacent pixels can be reduced to eliminate a noise pattern in the vertical direction.

21 Claims, 14 Drawing Sheets

FIG.1A

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

FIG.1B

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

FIG. 2A

| | | | | | | | |
|---|---|---|---|---|---|---|---|
| + | I | + | I | + | I | + | I |
| + | I | + | I | + | I | + | I |
| + | I | + | I | + | I | + | I |
| + | I | + | I | + | I | + | I |
| + | I | + | I | + | I | + | I |
| + | I | + | I | + | I | + | I |
| + | I | + | I | + | I | + | I |
| + | I | + | I | + | I | + | I |

FIG. 2B

| | | | | | | | |
|---|---|---|---|---|---|---|---|
| I | + | I | + | I | + | I | + |
| I | + | I | + | I | + | I | + |
| I | + | I | + | I | + | I | + |
| I | + | I | + | I | + | I | + |
| I | + | I | + | I | + | I | + |
| I | + | I | + | I | + | I | + |
| I | + | I | + | I | + | I | + |
| I | + | I | + | I | + | I | + |

FIG.3A

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG.3B

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

METHOD AND APPARATUS FOR DRIVING LIQUID CRYSTAL DISPLAY PANEL IN INVERSION

BACKGROUND OF THE INVENTION

1. Field of the Invention

This invention relates to a technique for driving a liquid crystal display device, and more particularly to a liquid crystal panel driving method of driving a liquid crystal panel using an inversion system and an apparatus thereof.

2. Description of the Prior Art

Generally, a liquid crystal display device controls the light transmissivity of liquid crystal cells in a liquid crystal panel to display a picture corresponding to a video signal. Such a liquid crystal display device uses a line-inversion system, a column-inversion system, a dot-inversion system and a group-inversion system, etc. so as to drive the liquid crystal cells in the liquid crystal panel. In a liquid crystal panel driving method of line-inversion system, as shown in FIG. 1A and FIG. 1B, the polarities of data signals applied to the liquid crystal panel are inverted in accordance with row lines, that is, gate lines on the liquid crystal panel and in accordance with frames. In a liquid crystal panel driving method of column-inversion system, as shown in FIG. 2A and FIG. 2B, the polarities of data signals applied to the liquid crystal panel are inverted in accordance with column lines, that is, source lines on the liquid crystal panel and in accordance with frames. In a liquid crystal panel driving method of dot-inversion system, as shown in FIG. 3A and FIG. 3B, data signals having polarities contrary to the adjacent liquid crystal cells on the gate lines and to the adjacent liquid crystal cells on the data lines are applied to each liquid crystal cells in the liquid crystal panel, and the polarities of data signals applied to all liquid crystal cells in the liquid crystal panel are inverted every frame. In other words, in the dot-inversion system, data signals are applied to the liquid crystal cells in the liquid crystal panel in such a manner that the positive(+) polarity and the negative(−) polarity appear alternately as shown in FIG. 3A as it goes from the liquid crystal cell at the left upper end into the liquid crystal cells at the right side and into the liquid crystal cells at the lower side when a video signal in the odd-numbered frame is displayed; while data signals are applied to the liquid crystal cells in the liquid crystal panel in such a manner that the positive (+) polarity and the negative(−) polarity appear alternately as shown in FIG. 3B as it goes from the liquid crystal cell at the left upper end into the liquid crystal cells at the right side and into the liquid crystal cells at the lower side when a video signal in the even-numbered frame is displayed.

The line-inversion system in the above-mentioned liquid crystal panel driving method has a serious crosstalk in the horizontal direction. Particularly, when a picture alternated with two colors (i.e., a color with a medium gray scale and a black color) depending on the line is displayed on the liquid crystal panel by the liquid crystal panel driving method of line inversion system, a serious flicker emerges between the horizontal lines. Similarly, when a picture alternated with two colors (i.e., a color with a medium gray scale and a black color) depending on the line is displayed on the liquid crystal panel by the liquid crystal panel driving method of column inversion system, a serious crosstalk in the vertical direction is generated. The dot-inversion system in which the polarities of the data signals are inverted in both the vertical and horizontal directions unlike the line-inversion system and the column inversion system provides better picture quality than the line- and column-inversion systems. Recently, owing to such an advantage, the liquid crystal panel driving method of dot-inversion system has been often used.

However, the liquid crystal panel driving method of dot-inversion system has a problem in that a brightness difference is generated at a boundary portion between column driver integrated circuits (IC'S). This generation of the brightness difference at the boundary portion between the column driver IC's is caused by an output deviation of the column driver IC's and a large difference in a voltage Vgs between the gate and the source of a thin film transistor (TFT) generated because the polarities of video signals applied to the liquid crystal cells at the boundary portion between the column driver IC's is opposed to each other.

The foregoing will be described in detail with reference to FIG. 4 to FIG. 6B. Each pixel on the liquid crystal panel can be expressed by an equivalent circuit as shown in FIG. 4. In FIG. 4, the pixel includes a TFT connected between a gate line GL and a data line DL, and a liquid crystal cell Clc connected between a source terminal of the TFT and a common voltage line CL. Further, the pixel includes a parasitic capacitor Cgs formed between the source terminal of the TFT and the gate line GL, and a parasitic resistor Rtft existing between the drain terminal and the source terminal of the TFT. The parasitic resistor Rtft is an equivalent resistance between the drain terminal and the source terminal when the TFT is turned off, which does not have a fixed value. The liquid crystal cell Clc charges a difference voltage between a video signal at the data line DL and a common voltage Vcom applied to the common voltage line CL until a time interval when the TFT maintains an ON state, that is, until a time interval when a gate high voltage Vgh is applied to the gate line GL. Accordingly, the difference voltage charged in the liquid crystal cell Clc becomes different depending on the polarity of the video signal and an output deviation of the column driver IC's.

Referring to FIG. 5A and FIG. 5B, there are shown a liquid crystal panel 10 having liquid crystal cells arranged in a matrix type, N column driver IC's 12 for individually applying a video signal to M data lines DL, and J gate driver IC's 14 for individually driving K gate lines GL. Herein, J, K, M and N are an integer. The N column driver IC's 12 apply video signals with a contrary polarity to the adjacent data lines DL in such a manner to be synchronized with a time interval when the gate high voltage Vgh is sequentially applied to the gate lines GL by the J gate driver IC's 14. The pixels at the oblique-lined boundary portion positioned between the column driver IC's 12 are supplied with video signals having a polarity contrary to the video signals applied to the adjacent pixels. Voltages charged in the odd-numbered pixels P(J*(2I−1),M), P(J*(2I−1),2M), . . . , P(J*(2I−1), (N−1)*M) and P(J*(2I−1),M+1), P(J*(2I−1), 2*M+1), . . . , P(J*(2I−1), (N−1)*M+1) in the data line direction of the pixels P(J*K,M), P(J*K,2M), . . . , P(J*K, (N−1)*M) connected to the left data lines DL and the pixels P(J*K,M+1), P(J*K,2*M+1), . . . , P(J*K,(N−1)*M+1) connected to the right data line DL at the boundary portions of the adjacent column driver IC's 12 in the odd-numbered frames as shown in FIG. 5A are represented by FIG. 6A and FIG. 6B, respectively. Herein, I is an integer. FIG. 6A represents a voltage Vgs between the gate and the source charged in the odd-numbered pixels P(J*(2I−1),M), P(J*(2I−1),2M), . . . , P(J*(2I−1), (N−1)*M) connected to the left data lines at the boundary portions between the column driver IC's 12, whereas FIG. 6B represents a voltage Vgs between the gate and the source charged in the odd-numbered pixels P(J*(2I−1),M+1), P(J*(2I−1),2*M+1), . . . , P(J*(2I−1), (N−1)*M+1) connected to the right data lines at the boundary portions between the column driver IC's 12 in the odd-numbered frames. As seen from FIG. 6A and FIG. 6B, the voltage Vgs between the gate and the source charged in the odd-numbered pixels P(J*(2I−1),M), P(J*(2I−1), 2M), . . . , P(J*(2I−1), (N−1)*M) connected to the left data lines at the boundary portions in the odd-numbered frames becomes much smaller than the voltage Vgs between the gate and the source charged in the odd-numbered pixels P(J*(2I−1),M+1), P(J*(2I−1),2*M+1), . . . , P(J*(2I−1), (N−1)*M+1) connected to the right data lines at the boundary portions. A difference in the voltages Vgs between the gates and the sources charged in the adjacent pixels within the boundary portions emerges at the even-numbered pixels P(J*2I,M), P(J*2I,2M), . . . , P(J*2I, (N−1)*M) and P(J*2I, M+1), P(J*2I,2M+1), . . . , P(J*2I,(N−1)*M+1) in the data line direction in opposition to the odd-numbered pixels P(J*(2I−1),M), P(J*(2I−1),2M), . . . , P(J*(2I−1), (N−1)*M) and P(J*(2I−1),M+1), P(J*(2I−1),2*M+1), . . . , P(J*(2I−1), (N−1)*M+1), respectively. Accordingly, since a brightness difference of the displayed picture becomes serious at the boundary portions between the column driver IC's 12, a noise pattern at the vertical line emerges on the field. Such a phenomenon becomes more serious as the output deviation of the column driver IC's 12 goes larger. The video signal applied to each pixel cell in the even-numbered frames following the odd-numbered frames has a polarity contrary to that in the odd-numbered frames. In the even-numbered frames, a voltage Vgs between the gate and the source charged in the odd-numbered pixels P(J*(2I−1),M), P(J*(2I−1),2M), . . . , P(J*(2I−1), (N−1)*M) connected to the left data lines at the boundary portions between the column driver IC's 12 is as shown in FIG. 6B. On the other hand, a voltage Vgs between the gate and the source charged in the odd-numbered pixels P(J*(2I−1),M+1), P(J*(2I−1),2*M+1), . . . , P(J*(2I−1), (N−1)*M+1) connected to the right data lines at the boundary portions between the column driver IC's 12 is as shown in FIG. 6A. Accordingly, in the even-numbered frames, the voltage Vgs between the gate and the source charged in the odd-numbered pixels P(J*(2I−1),M), P(J*(2I−1),2M), . . . , P(J*(2I−1), (N−1)*M) connected to the left data lines at the boundary portions becomes much smaller than the voltage Vgs between the gate and the source charged in the odd-numbered pixels P(J*(2I−1),M+1), P(J*(2I−1),2*M+1), . . . , P(J*(2I−1), (N−1)*M+1) connected to the right data lines at the boundary portions. In the even-numbered frames, a difference in the voltages charged in the even-numbered pixels P(J*2I,M), P(J*2I, 2M), . . . , P(J*2I, (N−1)*M) and P(J*2I,M+1), P(J*2I,2M+1), . . . , P(J*2I,(N−1)*M+1) in the data line direction emerges in opposition to that in the odd-numbered pixels P(J*(2I−1),M), P(J*(2I−1),2M), . . . , P(J*(2I−1), (N−1)*M) and P(J*(2I−1),M+1), P(J*(2I−1),2*M+1), . . . , P(J*(2I−1),(N−1)*M+1), respectively.

Meanwhile, a large output deviation may be generated between the output terminals of the same column driver IC 12. In this case, a large brightness difference is generated between the adjacent pixels in the data line direction of the pixel areas within the same column driver IC 12 in similarity to the above-mentioned phenomenon appearing at the boundary portions between the column driver IC's 12.

As a result, in the conventional dot-inversion system, a voltage difference and a current difference charged in the adjacent pixels in the data line direction becomes large, and a large brightness difference is generated between the adjacent pixels in the data line direction due to an output deviation within the column driver IC 12 or an output deviation between the column driver IC's 12 which is more increased at a higher resolution.

SUMMARY OF THE INVENTION

Accordingly, it is an object of the present invention to provide an inversion-system liquid crystal panel driving method and apparatus that is adaptive for reducing a brightness difference between adjacent pixels in the dot inversion system.

In order to achieve these and other objects of the invention, a method of driving a liquid crystal panel having pixels in an inversion system according to one aspect of the present invention includes the steps of setting at least one pixel block each of which includes at least two data lines within the liquid crystal panel; allowing the adjacent pixels in a gate line direction within the pixel block to respond to data signals having the same polarity; and allowing the pixels within the other pixel areas except for the pixel block to respond to data signals having a polarity contrary to the adjacent pixels at the left and right sides thereof.

An apparatus for driving a liquid crystal panel in an inversion system according to another aspect of the present invention includes first signal supplying means for setting at least one pixel block each of which includes at least two data lines within the liquid crystal panel to apply data signals having the same polarity to the adjacent pixels in a gate line direction within the pixel block; and second signal supplying means for applying data signals having a polarity contrary to the adjacent pixels at the left and right sides thereof to the pixels within the other pixel areas except for the pixel block area.

BRIEF DESCRIPTION OF THE DRAWINGS

These and other objects of the invention will be apparent from the following detailed description of the embodiments of the present invention with reference to the accompanying drawings, in which:

FIGS. 1A and 1B illustrate polarity patterns of data signals applied to liquid crystal cells in the liquid crystal panel by a liquid crystal panel driving method of line-inversion system;

FIGS. 2A and 2B illustrate polarity patterns of data signals applied to liquid crystal cells in the liquid crystal panel by a liquid crystal panel driving method of column-inversion system;

FIGS. 3A and 3B illustrate polarity patterns of data signals applied to liquid crystal cells in the liquid crystal panel by a liquid crystal panel driving method of dot-inversion system;

DETAILED DESCRIPTION OF THE PREFERRED EMBODIMENT

Figure 4:
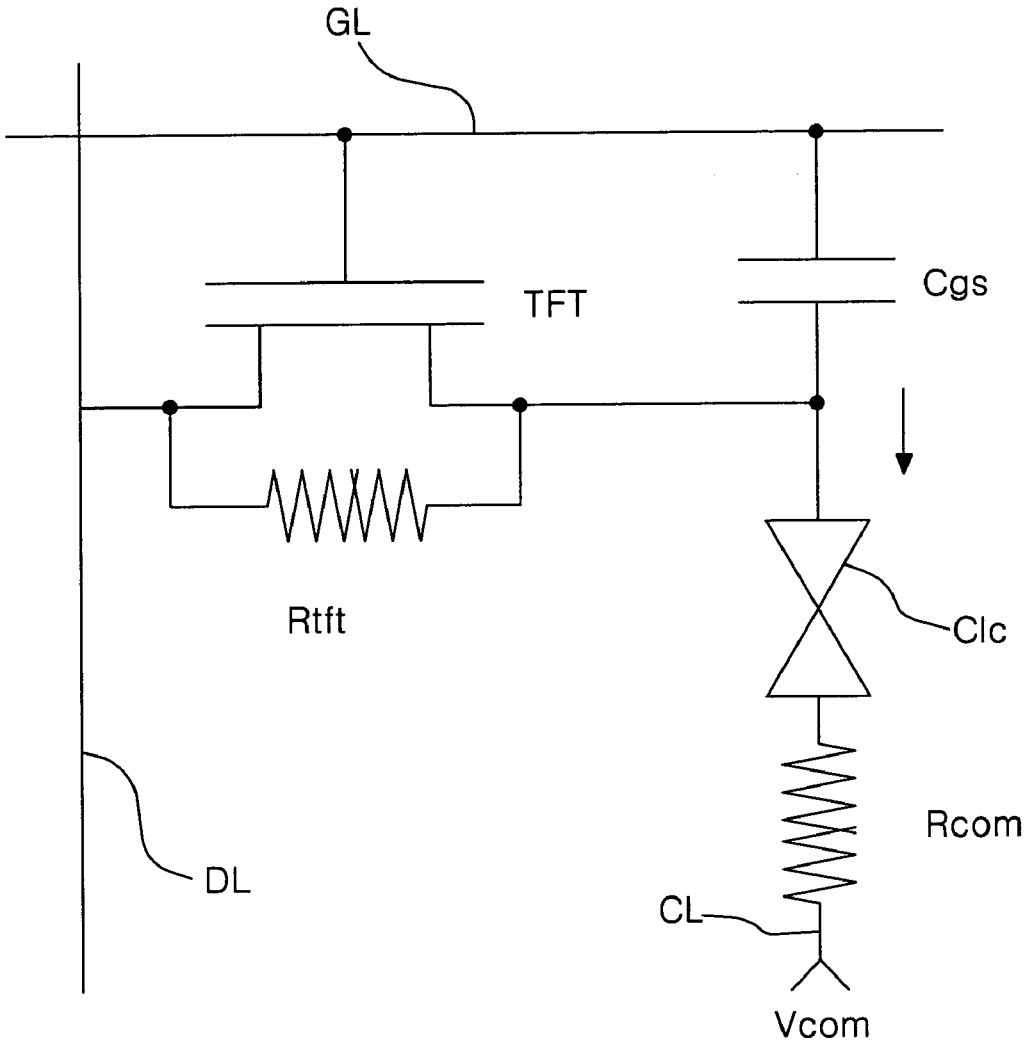
FIG. 4 is a view for explaining a voltage charged in the liquid crystal cell.
Figure 5A:
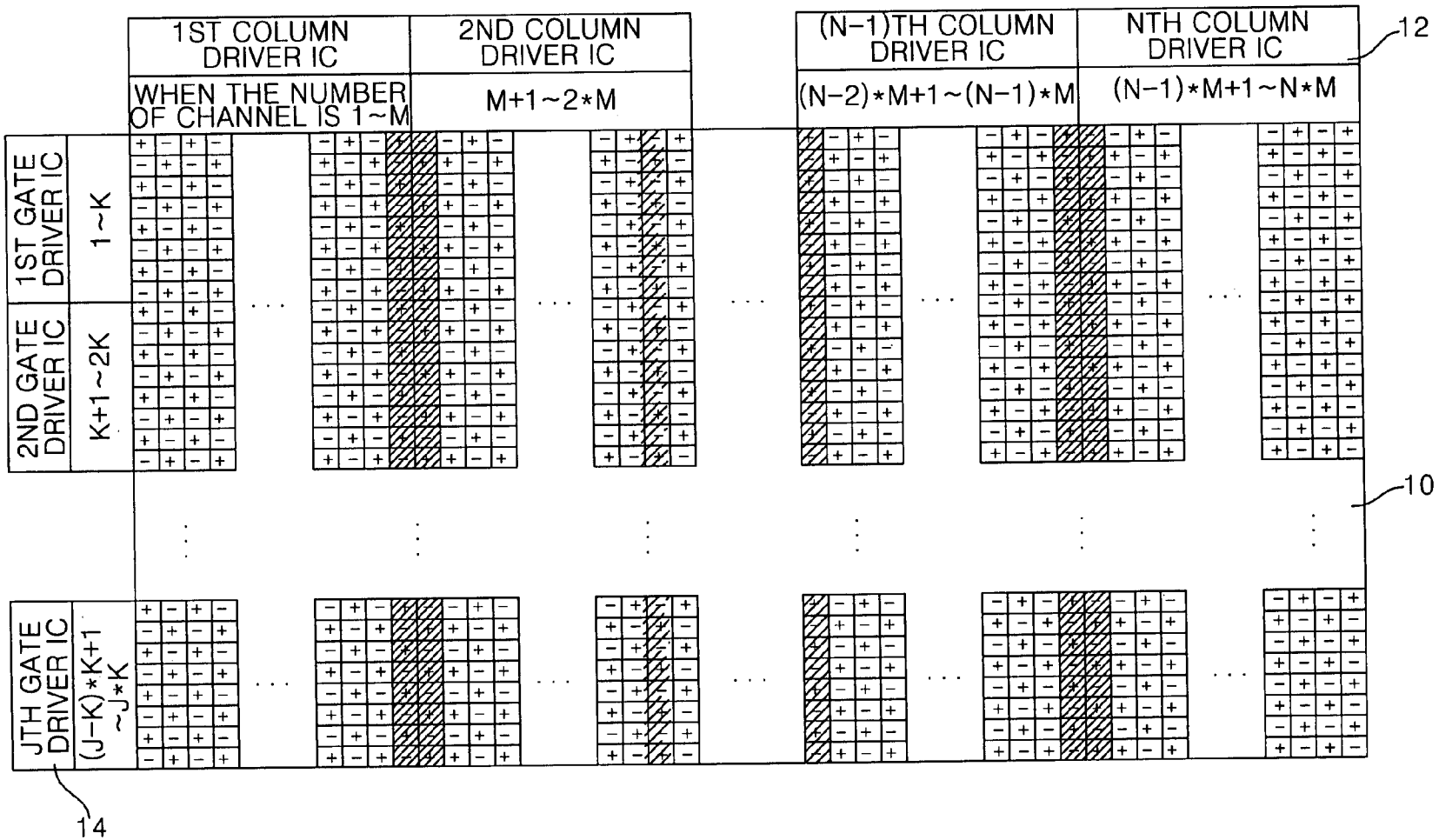
FIGS. 5A and 5B represent a brightness difference in the data line direction in a conventional dot-inversion system.
Figure 5B:
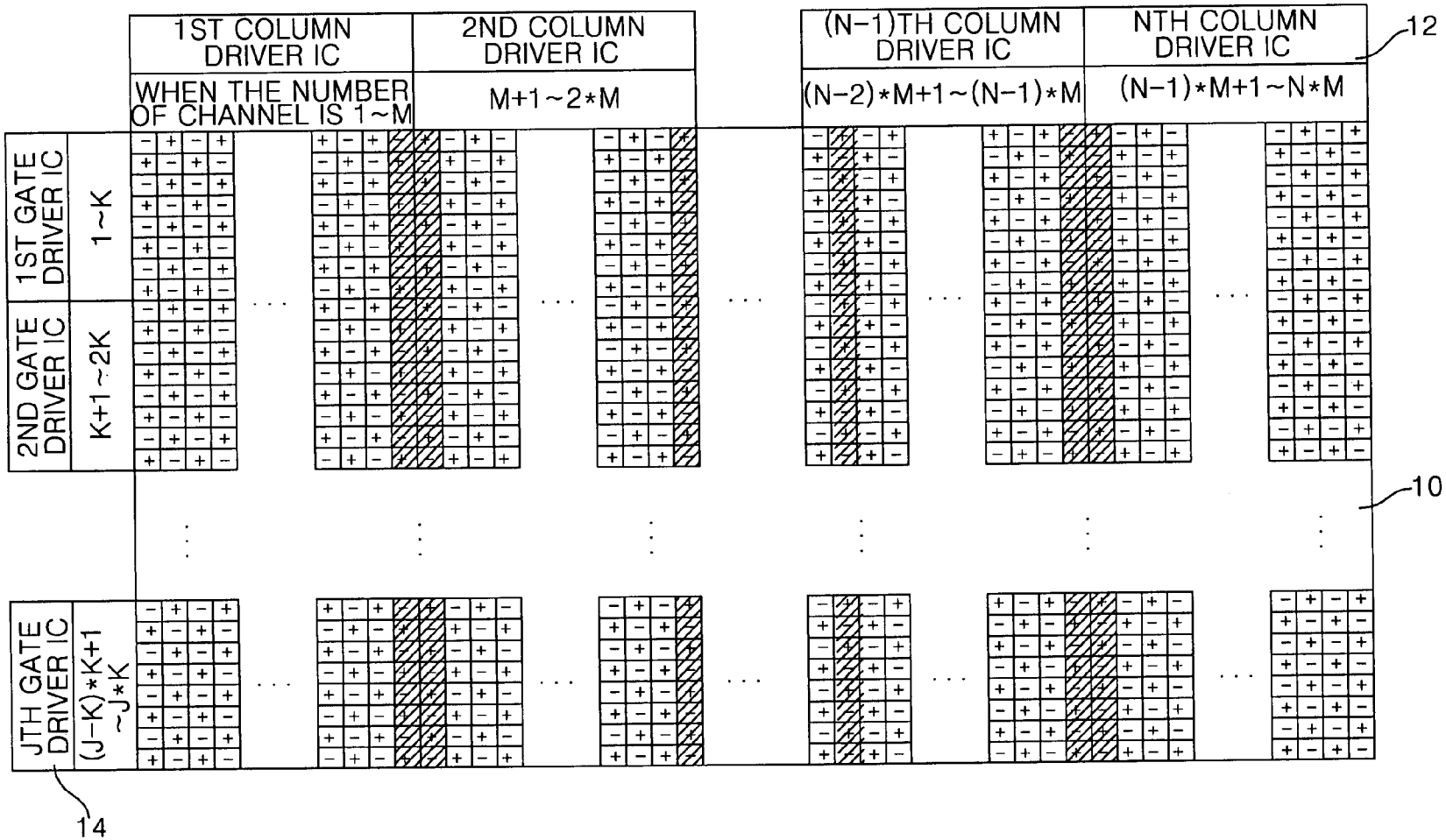
Figure 6A:
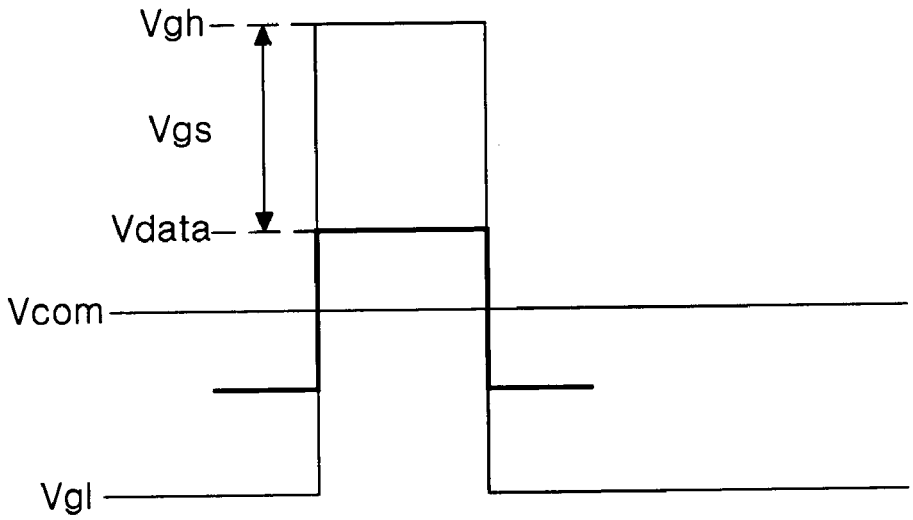
FIGS. 6A and 6B are waveform diagrams of a voltage charged in the liquid crystal cell in accordance with the polarity of a video signal.
Figure 6B:
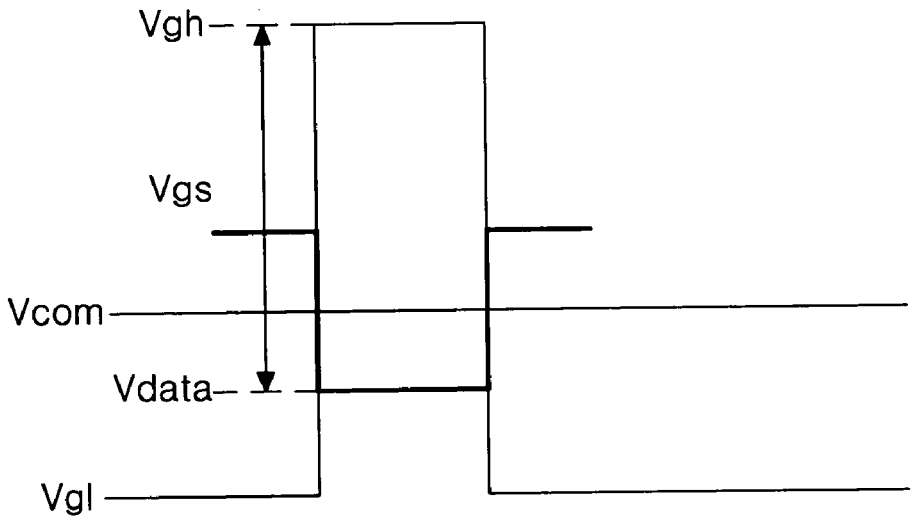
Figure 7A:
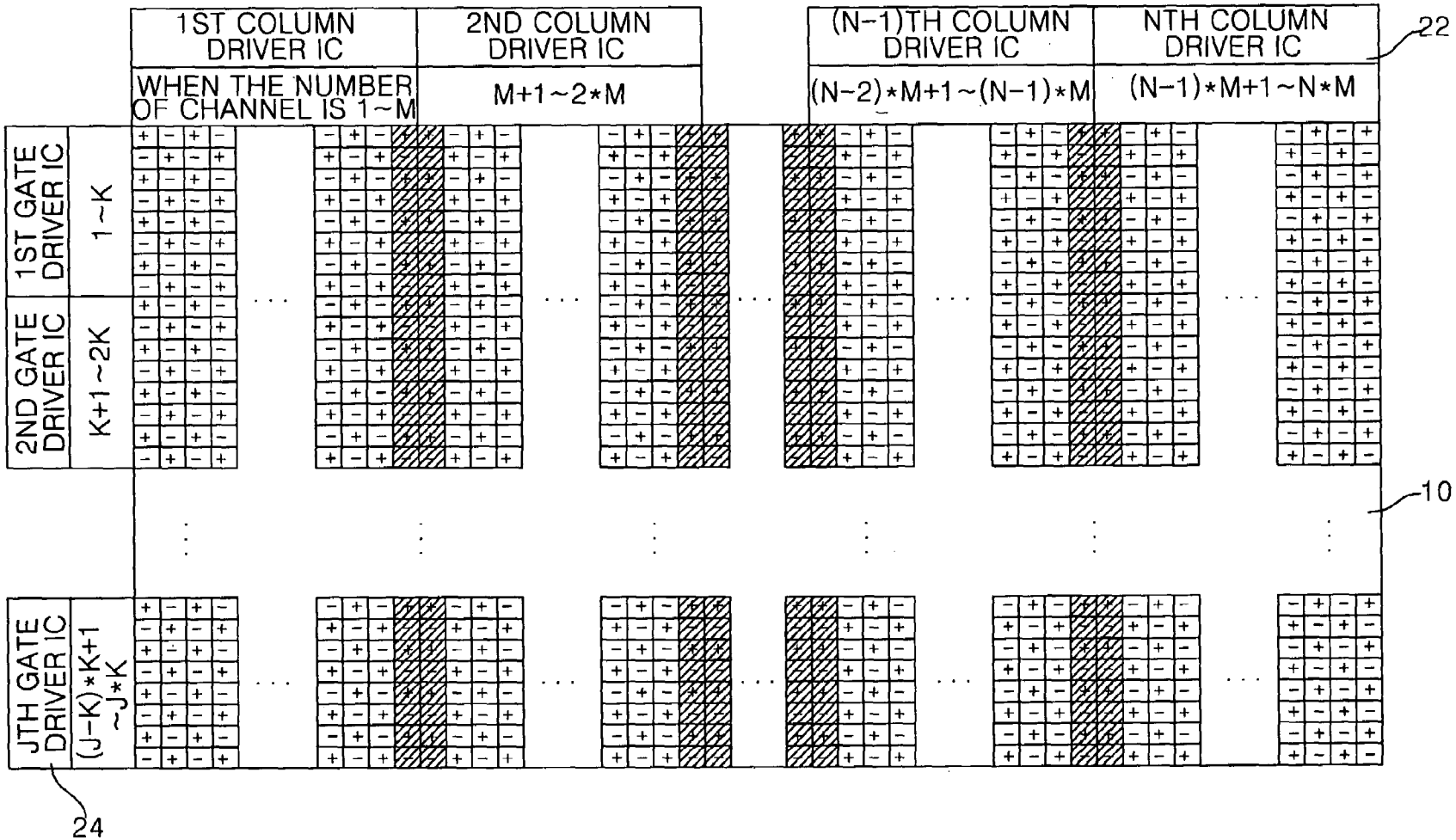
FIGS. 7A and 7B illustrate the polarity of a video signal applied to the liquid crystal panel of inversion system according to a first embodiment of the present invention.
Figure 7B:
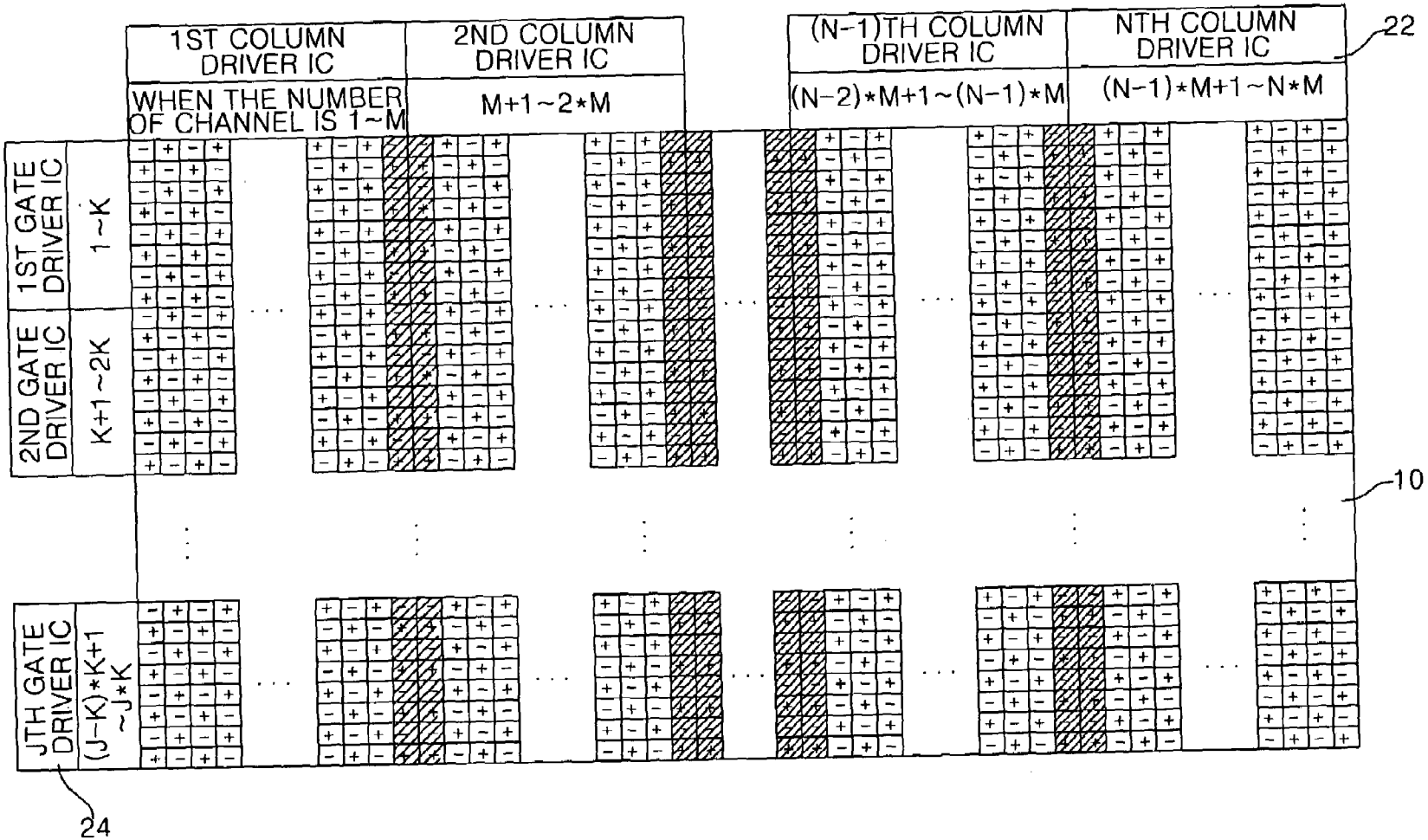

Referring to FIG. 7A and FIG. 7B, there is shown a method of driving a liquid crystal panel in inversion according to a first embodiment of the present invention that makes a line inversion of adjacent pixels at boundary portions of column driver IC's 22 and drives the other pixels in dot-inversion. N column driver IC's 22 apply video signals with a contrary polarity to adjacent data lines DL in such a manner to be synchronized with a time interval when a gate high voltage Vgh is applied to gate lines GL by J gate driver IC's 24. Also, the N column driver IC's 22 apply video signals with the same polarity to the data lines DL included in the boundary portions in such a manner that the video signal with the same polarity is applied to the adjacent pixel cells in the gate line direction at the oblique-lined boundary portions. In the odd-numbered frames as shown in FIG. 7A, video signals with a positive polarity are applied to the odd-numbered pixels P(J*(2I−1),M), P(J*(2I−1),2M), . . . , P(J*(2I−1), (N−1)*M) and P(J*(2I−1),M+1), P(J*(2I−1), 2*M+1), . . . , P(J*(2I−1), (N−1)*M+1) in the data line direction of the pixels P(J*K,M), P(J*K,2M), . . . , P(J*K, (N−1)*M) connected to the left data lines DL and the pixels P(J*K,M+1), P(J*K,2*M+1), . . . , P(J*K, (N−1)*M+1) connected to the right data line DL at the boundary portions of the adjacent column driver IC's 22. Also, video signals with a negative polarity are applied to the even-numbered pixels P(J*2I,M), P(J*2I,2M), . . . , P (J*2I,(N−1)*M) and P(J*2I, M+1), P(J*2I,2M+1), . . . , P(J*2I, (N−1)*M+1) in the data line direction of the pixels P(J*K,M), P(J*K, 2M), . . . , P(J*K,(N−1)*M) and P(J*K,M+1), P(J*K,2*M+1), . . . , P(J*K, (N−1)*M+1) at the boundary portions. A voltage Vgs between the gate and the source charged in the odd-numbered pixels P(J*(2I−1),M), P(J*(2I−1),2M), . . . , P(J*(2I−1), (N−1)*M) and P(J*(2I−1),M+1), P(J*(2I−1), 2*M+1), . . . , P(J*(2I−1), (N−1)*M+1) within the boundary portions in the data line direction is as shown in FIG. 6A. A voltage Vgs between the gate and the source charged in the even-numbered pixels P(J*2I,M), P(J*2I,2M), . . . , P(J*2I, (N−1)*M) and P(J*2I,M+1), P(J*2I,2M+1), . . . , P(J*2I, (N−1)*M+1) is as shown in FIG. 6B.

A video signal applied to each pixel cell in the even-numbered frames as shown in FIG. 7B following the odd-numbered frames has a polarity contrary to that in the odd-numbered frames. In the even-numbered frames, the boundary portions between the column driver IC's 22 are driven in a line inversion system having a polarity contrary to the previous odd-numbered frames. Video signals with a negative polarity are applied to the odd-numbered pixels P(J*(2I−1),M), P(J*(2I−1),2M), . . . , P(J*(2I−1), (N−1)*M) and P(J*(2I−1),M+1), P(J*(2I−1),2*M+1), . . . , P(J*(2I−1), (N−1)*M+1) in the data line direction of the pixels P(J*K, M), P(J*K,2M), . . . , P(J*K,(N−1)*M) connected to the left data lines DL and the pixels P(J*K,M+1), P(J*K,2*M+1), . . . , P(J*K,(N−1)*M+1) connected to the right data line DL at the boundary portions. Also, video signals with a positive polarity are applied to the even-numbered pixels P(J*2I,M), P(J*2I,2M), . . . , P(J*2I, (N−1)*M) and P(J*2I, M+1), P(J*2I,2M+1), . . . , P(J*2I,(N−1)*M+1) in the data line direction of the pixels P(J*K,M), P(J*K,2M), . . . , P(J*K, (N−1)*M) and P(J*K,M+1), P(J*K,2*M+1), . . . , P(J*K, (N−1)*M+1) at the boundary portions. A voltage Vgs between the gate and the source charged in the odd-numbered pixels P(J*(2I−1),M), P(J*(2I−1),2M), . . . , P(J*(2I−1), (N−1)*M) and P(J*(2I−1),M+1), P(J*(2I−1),2*M+1), . . . , P(J*(2I−1), (N−1)*M+1) within the boundary portions in the data line direction is as shown in FIG. 6B. A voltage Vgs between the gate and the source charged in the even-numbered pixels P(J*2I,M), P(J*2I,2M), . . . , P(J*2I, (N−1)*M) and P(J*2I,M+1), P(J*2I,2M+1), . . . , P(J*2I, (N−1)*M+1) is as shown in FIG. 6A. At the other portions of the liquid crystal panel 10 except for the boundary portions, the adjacent pixels at the upper, lower, left and right portions thereof are supplied with video signals having a polarity contrary to each other in such a manner to be opposed to the previous odd-numbered frames.

As a result, at the boundary portions between the column driver IC's 22, video signals having the same polarity are inverted and applied to the pixel cells in the gate line direction every frame, and video signals having a contrary polarity are applied to the adjacent pixel cells in the data line direction every frame. In other words, the boundary portions between the column driver IC's are driven in the line inversion system. On the other hand, the other portions of the liquid crystal panel 10 except for the boundary portions are driven in the dot inversion system because the adjacent pixels at the upper, lower, left and right portions thereof are supplied with video signals having a polarity contrary to each other.

Figure 8A:
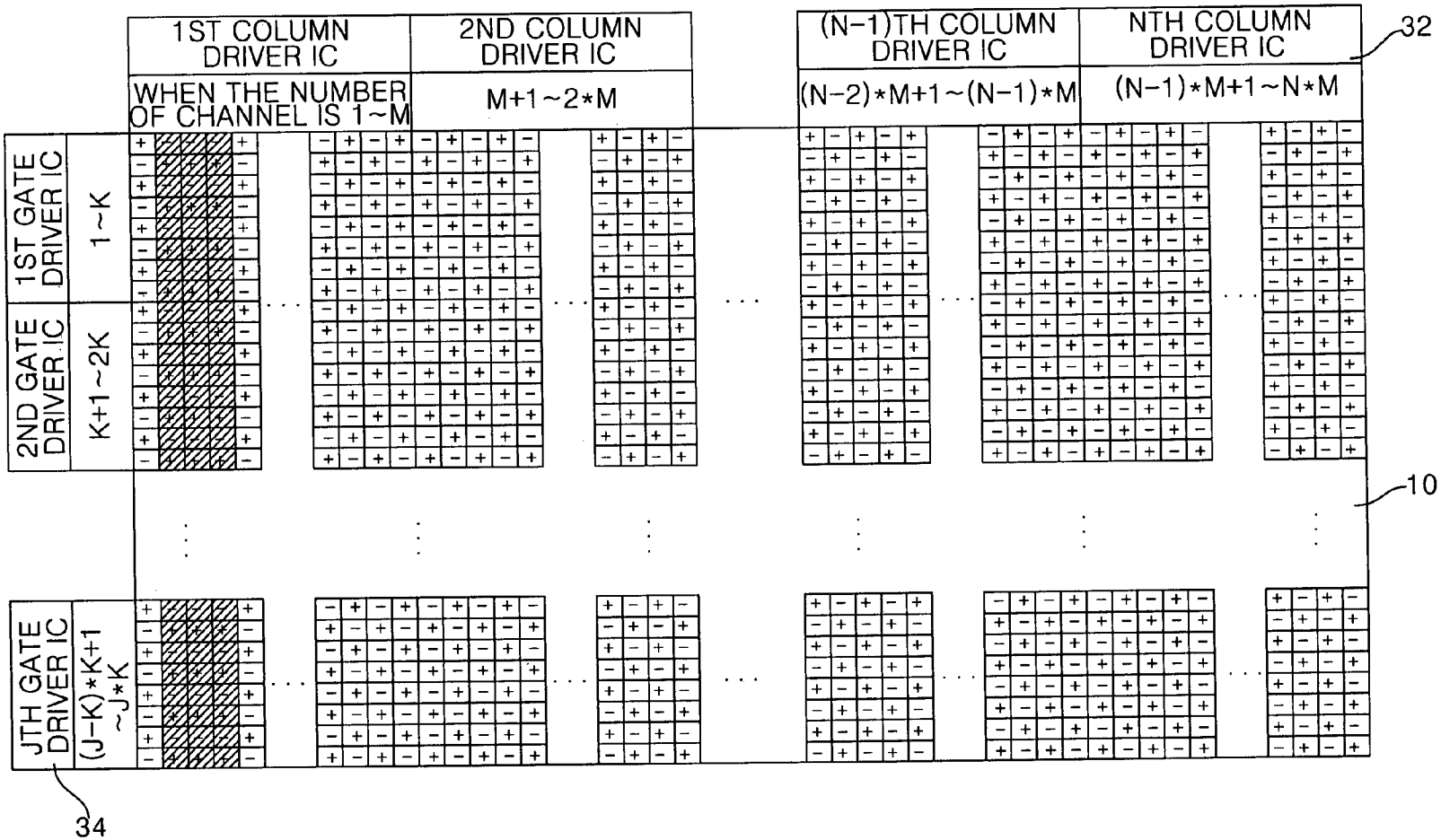
FIGS. 8A and 8B illustrate the polarity of a video signal applied to the liquid crystal panel of inversion system according to a second embodiment of the present invention.
Figure 8B:
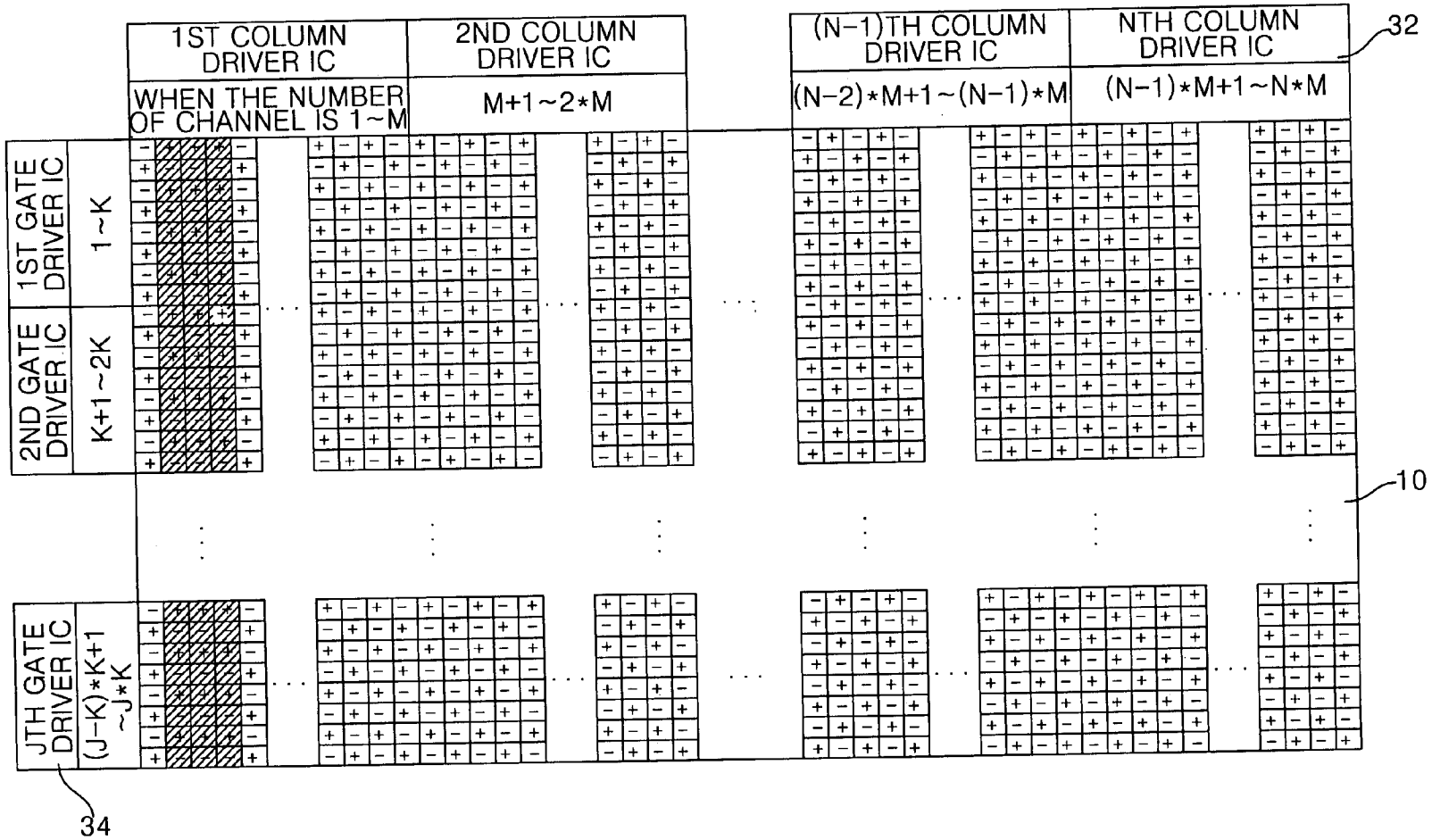

Referring now to FIG. 8A and FIG. 8B, there is shown a method of driving a liquid crystal panel in inversion according to a second embodiment of the present invention wherein pixels connected to a plurality of data lines DL to each of which a video signal is applied from a first column driver IC 32 are driven in the line-inversion system while the other pixels are driven in the dot-inversion system. The first column driver IC 32 applies the same polarity of video signal to the pixel cells in the gate line direction connected to the second to fourth data lines DL when output signals generated from the output terminals connected to the second to fourth data lines DL of its output terminals have a large deviation.

In the odd-numbered frames as shown in FIG. 8A, a negative polarity of video signal is applied to the odd-numbered pixels P(J*(2I−1),2), P(J*(2I−1),3), P(J*(2I−1),4) in the data line direction of the pixels P(J*K,2), P(J*K,3), P(J*K,4) connected to the data lines DL at the oblique-lined area within the adjacent first column driver IC 32. Also, a positive polarity of video signal is applied to the even-numbered pixels P(J*2I,2), P(J*2I,3), P(J*2I,4) in the data line direction of the pixels P(J*K,2), P(J*K,3), P(J*K,4) connected to the data lines DL at the oblique-lined area. Accordingly, the odd-numbered pixels P(J*(2I−1),2), P(J*(2I−1),3), P(J*(2I−1),4) are charged by a voltage Vgs between the gate and the source as shown in FIG. 6B, whereas the even-numbered pixels P(J*2I,2), P(J*2I,3), P(J*2I,4) are charged by a voltage Vgs between the gate and the source as shown in FIG. 6A.

The video signal applied to each pixel cell in the even-numbered frames as shown in FIG. 8B following the odd-numbered frames has a polarity contrary to that in the odd-numbered frames. In the even-numbered frames, the oblique-lined area within the first column driver IC 32 is driven in the line-inversion system having a polarity contrary to the odd-numbered frames. A positive polarity of video signal is applied to the odd-numbered pixels in the data line direction of the pixels P(J*K,2), P(J*K,3), P(J*K,4) connected to the data lines DL at the oblique-lined area. Also, a negative polarity of video signal is applied to the even-numbered pixels in the data line direction of the pixels P(J*K,2), P(J*K,3), P(J*K,4) connected to the data lines DL at the oblique-lined area. Accordingly, the odd-numbered pixels P(J*(2I−1),2), P(J*(2I−1),3), P(J*(2I−1),4) are charged by a voltage Vgs between the gate and the source as shown in FIG. 6A, whereas the even-numbered pixels P(J*2I,2), P(J*2I,3), P(J*2I,4) are charged by a voltage Vgs between the gate and the source as shown in FIG. 6B.

As a result, the pixel cells in the gate line direction included in a partial area within the first column driver IC 32 are supplied with the same polarity of video signals, whereas the pixel cells in the data line direction are supplied with the opposite polarity of video signals. In other words, the partial area within the first column driver IC 32 is driven in the line-inversion system. Although the embodiment has illustrated the case where the output signals generated from the output terminals connected to the second to fourth data lines DL of the output terminals of the first column driver IC 32 have a large deviation, the pixel cells in the gate line direction included in the corresponding area in accordance with the output deviation may be driven in the line-inversion system at any column driver IC's 32. Also, the areas driven in the line-inversion system is not limited to the partial data line area, but may be an area including a plurality of data lines, for example, an area including four or eight data lines. At an area other than the area driven in the line-inversion system, the adjacent pixels at the upper, lower, left and right side of the corresponding area are supplied with the opposite polarity of video signals to be driven in the dot-inversion system.

Figure 9:
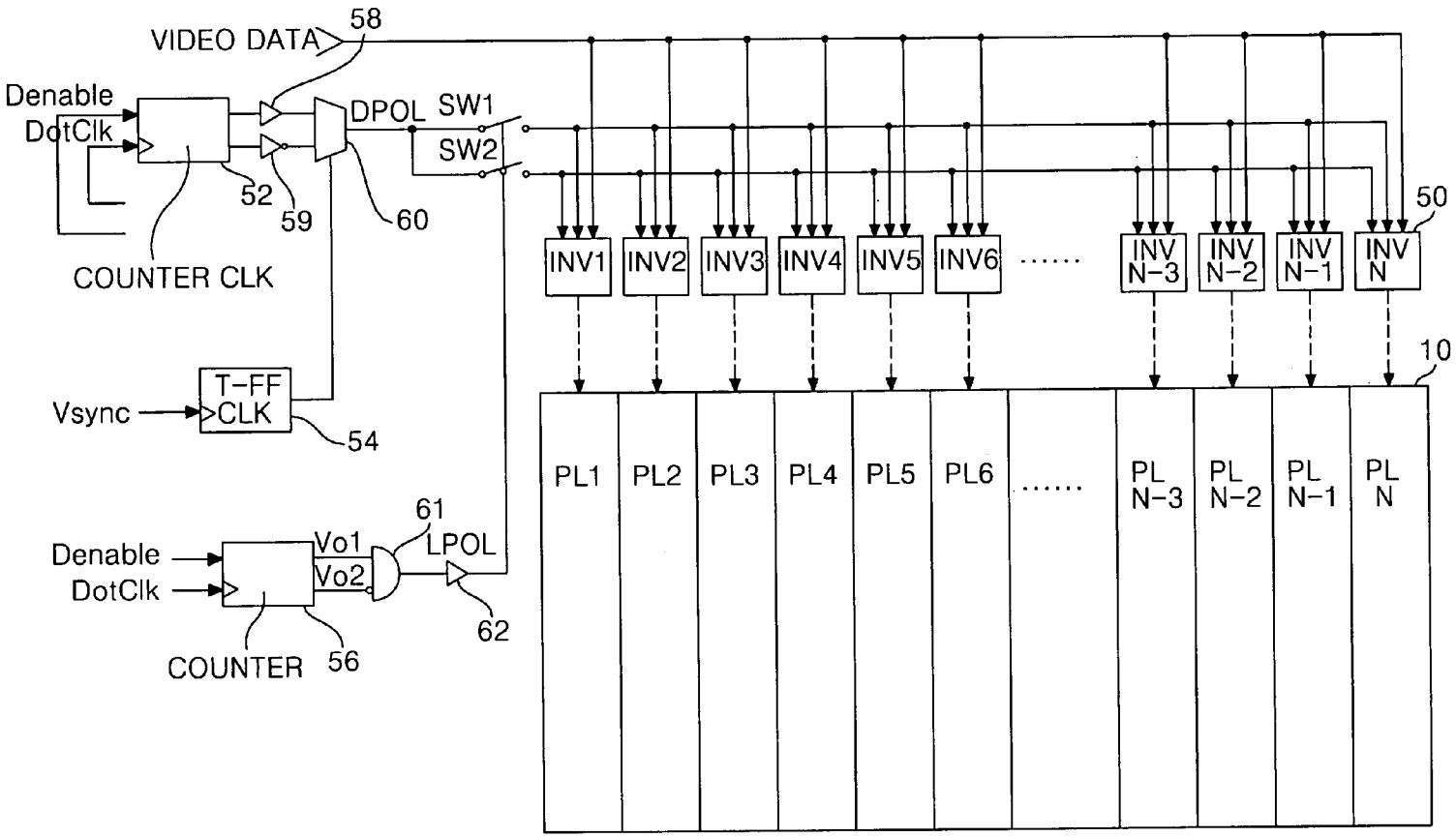
FIG. 9 is a block diagram showing a configuration of a liquid crystal panel driving apparatus of inversion system according to an embodiment of the present invention.
Figure 10:
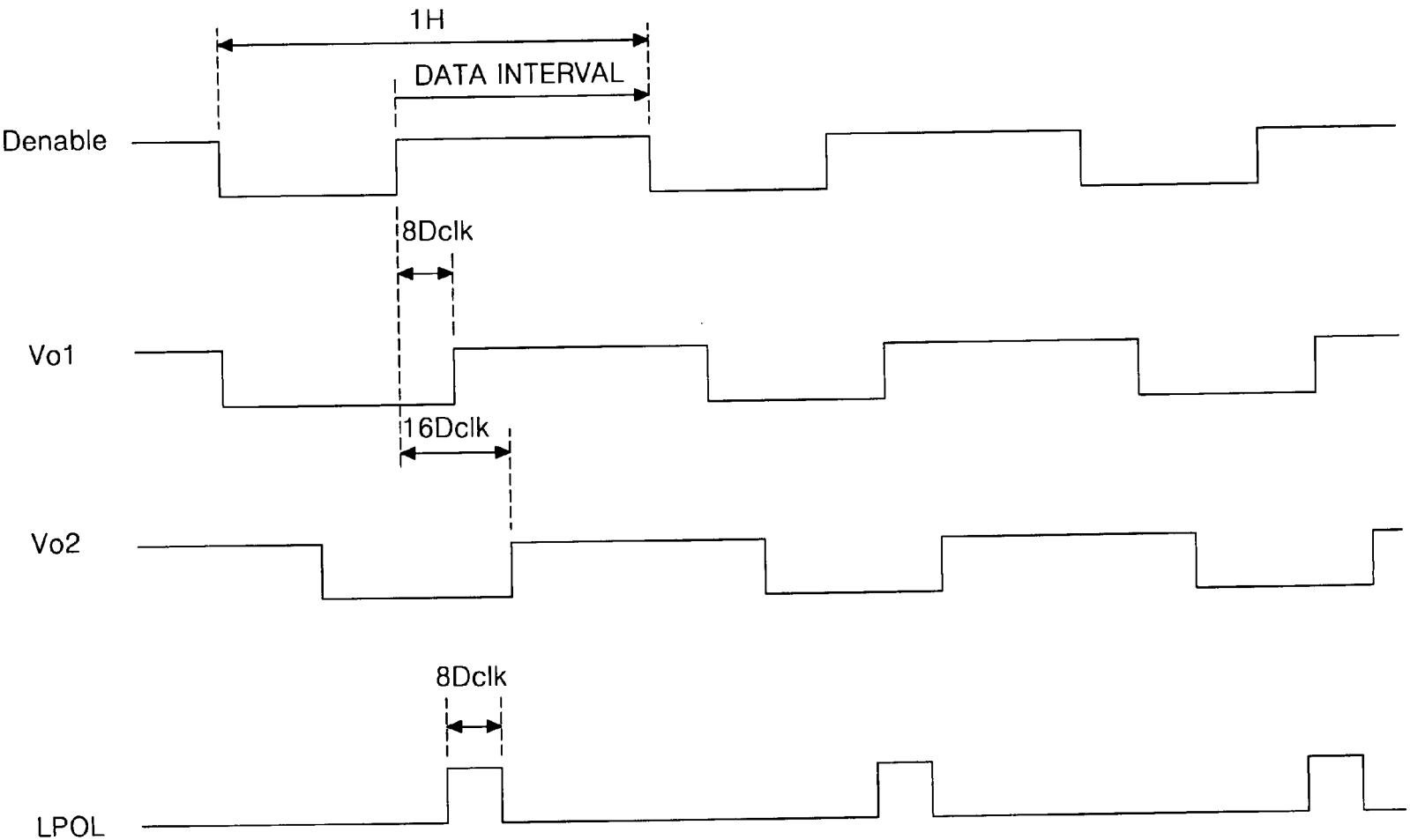
FIG. 10 is waveform diagrams of an output signal from each part of the liquid crystal panel driving apparatus of inversion system shown in FIG. 9.

FIG. 9 shows a liquid crystal display driving apparatus employing an inversion system according to the present invention. FIG. 10 is waveform diagrams of output signals and control signals of each part of the liquid crystal display driving apparatus shown in FIG. 9.

Referring to FIG. 9 and FIG. 10, the liquid crystal display driving apparatus includes a first counter 52 and a toggle flip-flop (T-FF) 54 for generating a dot-inversion control signal DPOL, a second counter 56 for generating a line-inversion control signal LPOL, and inverters INV1 to INVN for inverting the polarity of a video signal applied to each column pixel line PL1 to PLN in the dot-inversion system or in the line inversion system in accordance with the dot-inversion control signal DPOL or the line-inversion control signal LPOL. The counter 52 is initialized in a blanking interval of a data enable signal Denable as shown in FIG. 10 and performs a count operation by a dot clock signal DotClk applied to its clock terminal CLK in a data interval. The counter 52 makes a repetitive count operation until a certain integer by the dot clock signal DotClk to output a rectangular wave signal in which the dot clock signal DotClk is frequency-divided by a certain integer. This rectangular wave signal outputted from the counter 52 is inputted, via a buffer 58 and an inverter 59, to a multiplexor (MUX) 60. The T-FF 54 toggles a vertical synchronizing signal Vsync inputted thereto to generate a pulse signal every frame. The pulse signal outputted from the T-FF 54 is applied to a control terminal of the MUX 60. Thus, the MUX 60 selects a rectangular wave signal from the counter 52 phase-inverted by means of the inverter 59 as the dot-inversion control signal DPOL in the odd-numbered frame or in the even-numbered frame. In other words, a phase of the dot-inversion control signal DPOL is inverted every frame. This dot-inversion control signal DPOL is commonly applied to the inverters INV1 to INVN by switching of first and second switches SW1 and SW2. The second counter 56 is initialized in the blanking interval of the data enable signal Denable and performs a count operation by the dot clock signal DotClk applied to its clock terminal CLK. Two output signals Vo1 and Vo2 of the second counter 56 have a phase difference depending on the counted number. The two output signals Vo1 and Vo2 of the second counter 56 may have a phase difference corresponding to 8 dot clock signals DotClk. The second output signal Vo2 of the output signals having such a phase difference is phase-inverted and inputted to an AND gate 61. The AND gate 61 makes a logical product operation of the first output signal Vo1 from the second counter 56 and the inverted second output signal /Vo2 to generate the line-inversion control signal LPOL. Thus, the line-inversion control signal LPOL remains at a high logic from the rising edge of the first output signal Vo1 until the rising edge of the second output signal Vo2 when the two output signals Vo1 and Vo2 have a phase difference corresponding to 8 dot clock signals DotClk as shown in FIG. 10. At this time, a high logic interval of the line-inversion control signal LPOL has a width corresponding to 8 dot clock signals DotClk. Such a line-inversion control signal LPOL is applied to control terminals of the first and second switches SW1 and SW2. The first switch SW1 applies the dot-inversion control signal DPOL to the inverters INV1 to INVN when the line-inversion control signal LPOL remains at a high logic, whereas the second switch SW2 applies the dot-inversion control signal DPOL to the inverters INV1 to INVN when the line-inversion control signal LPOL remains at a low logic. If a high logic of line-inversion control signal LPOL is sampled and applied, only the odd-numbered inverters INV1, INV3, . . . , INVN−1 (wherein N is an even number) or the even-numbered inverters INV2, INV4, . . . , INVN of the inverters INV1 to INVN invert an input video data. On the other hand, the adjacent inverters to which a low logic of line-inversion control signal LPOL is sampled and applied invert an input video data at the same time. More specifically, if the line-inversion control signal LPOL is applied to the inverters INV1 to INVN as shown in FIG. 10, then the inverters INV8 to INV16 connected to the eighth to sixteenth column pixel lines PL8 to PL16 for 8 lines phase-invert an input video data at the same time. Each output signal of the inverters INV1 to INVN is applied, via a digital-to-analog (DA) converter and an output circuit (not shown), to the data line DL.

Figure 11:
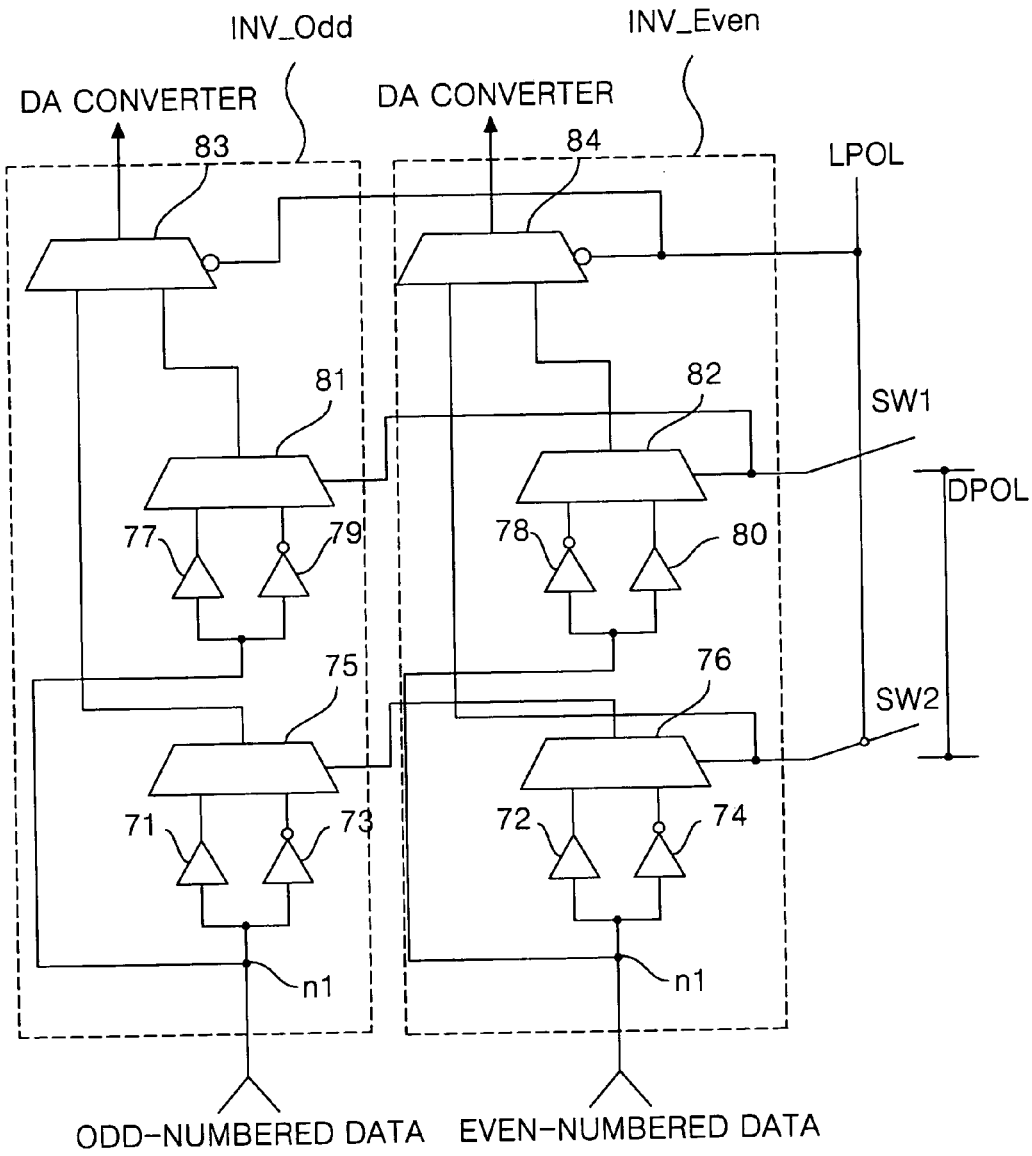
FIG. 11 is a detailed circuit diagram of each inverter shown in FIG. 9.

FIG. 11 is a detailed circuit diagram of each inverter shown in FIG. 9. Referring to FIG. 11, each of the inverters INV1 to INVN includes a first buffer 71 or 72 and a first inverter 73 or 74 for receiving a video data via a first node n1, a first MUX 75 or 76 for outputting any one of output signals of the first buffer 71 or 72 and the first inverter 73 or 74, a second buffer 77 or 80 and a second inverter 78 or 79 for receiving a video data via the first node n1, a second MUX 81 or 82 for outputting any one of output signals of the second buffer 77 or 80 and the second inverter 78 or 79, and a third MUX 83 or 84 for responding to the line-inversion control signal LPOL to output any one of an output signal of the first MUX 75 or 76 and an output signal of the second MUX 81 or 82. The dot-inversion control signal DPOL is commonly applied, via the second switch SW2, to the control terminals of the first MUX 75 in the odd-numbered inverter INV_Odd and the first MUX 76 in the even-numbered inverter INV_Even. The dot-inversion control signal DPOL is commonly applied, via the first switch SW1, to the control terminals of the second MUX 81 in the odd-numbered inverter INV_Odd and the second MUX 82 in the even-numbered inverter INV_Even. The line-inversion control signal LPOL controls the first and second switches SW1 and SW2, the third MUX 83 in the odd-numbered inverter INV_Odd and the third MUX 84 in the even-numbered inverter INV_Even simultaneously.

When the line-inversion control signal LPOL has a high logic, the first switch SW1 is turned on while the second switch SW2 is turned off. In this case, the second MUX 81 in the odd-numbered inverter INV_Odd applies odd-numbered data phase-inverted by means of the second inverter 79 to the third MUX 83, whereas the second MUX 82 in the even-numbered inverter INV_Even applies even-numbered data supplied with a phase being maintained via the second buffer 80 to the third MUX 84. The third MUX 83 in the even-numbered inverter INV_Odd outputs the phase-inverted odd-numbered data from the second MUX 81 to the DA converter, whereas the third MUX 84 in the even-numbered inverter INV_Even outputs the phase-non-inverted even-numbered data from the second MUX 82 to the DA converter.

When the line-inversion control signal LPOL has a low logic, the first switch SW1 is turned off while the second switch SW2 is turned on. In this case, the first MUX 75 in the odd-numbered inverter INV_Odd applies odd-numbered data phase-inverted by means of the first inverter 73 to the third MUX 83, whereas the first MUX 76 in the even-numbered inverter INV_Even applies the phase-inverted even-numbered data, via the first inverter 74 to the third MUX 84. The third MUX 83 in the even-numbered inverter INV_Odd outputs the phase-inverted odd-numbered data from the first MUX 75 to the DA converter, whereas the third MUX 84 in the even-numbered inverter INV_Even outputs the phase-inverted even-numbered data from the first MUX 76 to the DA converter.

Accordingly, only any one of the odd-numbered inverter INV_Odd and the even-numbered inverter INV_Even inverts an input video data in the case of being driven in the dot-inversion system, whereas both the odd-numbered inverter INV_Odd and the even-numbered inverter INV_Even inverts an input video data at the same time.

As described above, according to the present invention, the polarities of video signals applied to the column pixel lines having a brightness difference is identically made, thereby equally maintaining a voltage Vgs between the gate and the source charged in the pixels. Accordingly, a current amount charged in the adjacent pixels having a large brightness difference is supplied always equally, so that the brightness difference between the adjacent pixels can be reduced to eliminate a noise pattern in the vertical direction. Furthermore, a throughput and a picture quality can be improved.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a liquid crystal panel having pixels arranged at each intersection between gate lines and data lines in a matrix type in an inversion system, comprising the steps of:

setting at least one pixel block each of which includes at least two data lines within the liquid crystal panel;

allowing adjacent pixels in a gate line direction within the at least one pixel block to respond to data signals having the same polarity; and allowing each of the pixels outside the at least one pixel block to respond to data signals having a polarity contrary to pixels adjacently arranged at left and right sides thereof.

2. The method as claimed in claim 1, wherein the pixel block is positioned at a boundary portion between column drivers.

3. The method as claimed in claim 2, wherein data lines within at least one first plurality of consecutively arranged data lines are connected to adjacent column drivers.

4. The method as claimed in claim 1, wherein the pixel block includes at least two data lines to which a data is applied from the same column driver.

5. The method as claimed in claim 1, wherein all the pixels within the liquid crystal panel responds to the data signals having a polarity inverted every frame.

6. An apparatus for driving a liquid crystal panel having pixels arranged at each intersection between gate lines and data lines in a matrix type in an inversion system, comprising:

first signal supplying means for setting at least one pixel block each of which includes at least two data lines within the liquid crystal panel to apply data signals having the same polarity to adjacent pixels in a gate line direction within the at least one pixel block; and second signal supplying means for applying data signals to pixels outside the at least one pixel block, wherein the applied data signals have a polarity contrary to data signals applied to each of the pixels adjacently arranged at left and right sides thereof and also arranged outside the at least one pixel block.

7. The apparatus as claimed in claim 6, further comprising:

line-inversion control means for controlling the first signal supplying means to apply the data signals having the same polarity to the adjacent pixels in the gate line direction; and dot-inversion control means for controlling the second signal supplying means to apply the data signals having a polarity contrary to the pixels at the left and right sides thereof.

8. The apparatus as claimed in claim 6, wherein the first and second signal supplying means comprises:

at least two signal inverters for responding to control signals applied from the line-inversion control means and the dot-inversion control means to invert phases of input data signals.

9. The apparatus as claimed in claim 8, wherein all of the odd-numbered signal inverters supplied with odd-numbered data signals and the even-numbered signal inverters supplied with even-numbered data signals respond to the control signal from the line-inversion control means to invert the input data signals.

10. The apparatus as claimed in claim 8, wherein any one of the odd-numbered signal inverters supplied with odd-numbered data signals and the even-numbered signal inverters supplied with even-numbered data signals respond to the control signal from the line-inversion control means to invert the input data signals.

11. A method of driving a liquid crystal panel having gate lines, data lines crossing the gate lines, and pixels arranged in a matrix pattern at crossings of the gate and data lines, comprising:

applying video signals to at least one first plurality of consecutively arranged data lines such that video signals having the same polarity are applied to pixels adjacent each other along a gate line direction; and applying video signals to at least one second plurality of consecutively arranged data lines such that video signals having opposite polarities are applied to each of the pixels adjacent each other along a gate line direction, wherein data lines within the at least one second plurality of consecutively arranged data lines are not included within the at least one first plurality of consecutively arranged data lines.

12. The method as claimed in claim 11, further comprising providing a plurality of column drivers for applying the video signals, wherein each column driver is connected to a plurality of consecutively arranged data lines.

13. The method as claimed in claim 12, wherein data lines within at least one first plurality of consecutively arranged data lines are connected to adjacent column drivers.

14. The method as claimed in claim 12, wherein at least one first plurality of consecutively arranged data lines is connected to a single column driver.

15. The method as claimed in claim 11, further comprising inverting polarities of video signals applied to all of the pixels within the liquid crystal panel every frame.

16. An apparatus for driving a liquid crystal panel having gate lines, data lines crossing the gate lines, and pixels arranged in a matrix pattern at crossings of the gate and data lines, comprising:

first signal supplying means for applying video signals to at least one first plurality of consecutively arranged data lines such that video signals having the same polarity are applied to pixels adjacent each other along a gate line direction; and second signal supplying means for applying video signals to at least one second plurality of consecutively arranged data lines such that video signals having opposite polarities are applied to each of the pixels adjacent each other along a gate line direction, wherein data lines within the at least one second plurality of consecutively arranged data lines are not included within the at least one first plurality of consecutively arranged data lines.

17. The apparatus as claimed in claim 16, further comprising:

line-inversion control means for controlling the first signal supplying means to apply video signals having the same polarity to the pixels adjacent each other along the gate line direction; and dot-inversion control means for controlling the second signal supplying means to apply video signals having opposite polarities to the adjacent each other along in the gate line direction.

18. The apparatus as claimed in claim 16, wherein the first and second signal supplying means comprises:

at least two consecutively arranged signal inverters for responding to control signals appliable from the line-inversion control means and the dot-inversion control means and for inverting phases of video signals.

19. The apparatus as claimed in claim 18, wherein all odd-numbered signal inverters, supplied with odd-numbered data signals, and even-numbered signal inverters, supplied with even-numbered data signals, respond to the control signals from the line-inversion control means to invert the video signals.

20. The apparatus as claimed in claim 18, wherein any one of odd-numbered signal inverters, supplied with odd-numbered data signals, and even-numbered signal inverters, supplied with even-numbered data signals, respond to the control signals from the line-inversion control means to invert the video signals.

21. A liquid crystal display device have a plurality of gate lines crossing a plurality of data lines to define a plurality of pixels, comprising:

a plurality of data drivers; and a plurality of blocks of adjacent data lines each associated with one of the plurality of data drivers;

wherein pixels along a gate line in each of the plurality of blocks of adjacent data lines are driven using a dot inversion method such that adjacent pixels along the gate line have opposite polarities; and wherein pixels from at least two different blocks of adjacent data lines that are directly adjacent to one another along a gate line have the same polarity.

* * * * *